United States Patent [19]

Kellems et al.

[11] Patent Number: 4,995,323

[45] Date of Patent: Feb. 26, 1991

[54] MODULAR SHELVING AND HANGER BAR SYSTEM

[75] Inventors: Kenneth K. Kellems, Costa Mesa; William F. Ryczek, Azusa; Douglas R. Smith, Glendora, all of Calif.

[73] Assignee: The Stanley Works, New Britain, Conn.

[21] Appl. No.: 319,428

[22] Filed: Mar. 2, 1989

[51] Int. Cl.[5] ..... A47B 3/06

[52] U.S. Cl. ..... 108/157; 108/111; 211/135

[58] Field of Search ..... 108/157, 153, 111, 144, 108/106, 108; 211/135, 186, 190, 191, 183; 248/250, 235

[56] References Cited

U.S. PATENT DOCUMENTS

| | | | |
|---|---|---|---|
| 1,492,188 | 4/1924 | Young | 211/135 X |
| 2,578,460 | 12/1951 | Babin, Jr. . | |
| 2,589,947 | 3/1952 | Magnuson et al. | 108/157 |
| 2,598,691 | 6/1952 | Helt . | |
| 2,648,105 | 8/1953 | Kurtz . | |
| 2,682,689 | 7/1954 | Helt . | |
| 2,685,715 | 8/1954 | Helt . | |
| 2,788,902 | 4/1957 | Nanicki | 108/157 |
| 2,975,908 | 3/1961 | Huet . | |
| 3,007,583 | 11/1961 | Graham . | |
| 3,015,135 | 1/1962 | Dean et al. . | |
| 3,098,267 | 7/1963 | Dean et al. . | |
| 3,294,043 | 12/1966 | Joyce | 108/111 |
| 3,303,622 | 2/1967 | Minds, Jr. . | |
| 3,323,656 | 6/1967 | Weiss et al. | 108/42 X |
| 3,325,130 | 6/1967 | Smith et al. . | |
| 3,357,374 | 12/1967 | Smith et al. . | |
| 3,478,891 | 11/1969 | Kaeslin . | |
| 3,480,154 | 11/1969 | Telfer | 108/91 X |
| 3,538,842 | 11/1970 | Labbato . | |
| 3,563,182 | 2/1971 | MacFarlane et al. . | |
| 3,643,607 | 2/1972 | MacKenzie . | |
| 3,759,623 | 9/1973 | Hesse . | |
| 4,184,660 | 1/1980 | Anderson . | |
| 4,185,566 | 1/1980 | Adams . | |
| 4,203,373 | 5/1980 | Conti . | |
| 4,324,076 | 4/1982 | Honickman | 108/111 X |
| 4,356,777 | 11/1982 | Kellogg | 108/111 |
| 4,548,327 | 10/1985 | Kilkelly . | |
| 4,709,642 | 12/1987 | Briosi | 108/111 |

FOREIGN PATENT DOCUMENTS

| | | | |
|---|---|---|---|
| 852993 | 3/1944 | France | 211/135 |
| 608399 | 9/1948 | United Kingdom | 211/135 |

*Primary Examiner*—José V. Chen

*Attorney, Agent, or Firm*—Christie, Parker & Hale

[57] ABSTRACT

A modular shelving system has a pair of vertical supports for a central stack of shelves. Each shelf is supported by a pair of shelf support brackets extending between the vertical supports and the back wall of a closet, for example. Each shelf has a plurality of sheet metal planks of generally trapezoidal cross section which elastically snap into complementary bosses along the tops of the shelf support brackets. Similar shelves extend from the central stack to side walls of the closet and are supported there by side wall brackets which also have bosses along the top complementary to the cross section of the planks. Some of the brackets have sockets for receiving the ends of hanger bars beneath the shelves.

30 Claims, 6 Drawing Sheets

5
8
10
4
5
5
5
5
5
5
4
12
10
10
5
8
27

17
6
30
1
32
19
4
5
9
8
25
24
26
10
12

MODULAR SHELVING AND HANGER BAR SYSTEM

FIELD OF THE INVENTION

This invention relates to a modular shelving and hanger bar system adapted for easy installation in varied configurations in clothes closets of various sizes.

BACKGROUND OF THE INVENTION

It often provides economy of storage space to install shelves into closets under construction as well as into existing closets in the home. It is desirable to provide a versatile modular shelving and hanger bar system which could be configured in a variety of ways and installed in closets of varying sizes. It is also desirable that the components of the system be of lightweight yet strong materials, and that the assembled system have a solid, stable appearance as well as actually being rigid.

Some prior art shelving systems for the home after market are constructed of welded, coated wire, and although lightweight, do not present a sturdy appearance. Further, items smaller than the gaps between wire supports may not be stored with this type system.

Other prior art shelving systems are of wood, particle board, or sheet metal construction. These types of systems usually comprise shelves and vertical supports of single plank construction and require the retailer to stock a large variety of plank sizes to allow for versatility of configuration. Further, when packed for retail sale, these systems comprise large, heavy and unwieldy packages.

Some prior art systems have proposed creating shelf planks from smaller shelf segments, two inches wide for example. One such system contemplates an inter-plank linking mechanism on each plank segment allowing the required number of segments to be coupled together to form a shelf. However, attachment of the completed plank to a horizontal support bracket occurs only between the front and back plank segments and the horizontal support. The interior plank segments only rest against the horizontal support bracket and are susceptible to disturbance from beneath the segments. Another plank segment system requires a variety of cross members spanning between corresponding horizontal support brackets. These brackets must be attached to the support brackets by nuts and bolts and anchoring hardware.

Thus, it is desirable to provide a strong and lightweight modular shelving and hanger bar system having shelf plank segments which are each positively connected to horizontal support brackets. Further, it is desired that attachment of each plank segment to the support brackets be accomplished quickly and easily without the need for any additional fasteners.

The present invention fulfills these needs for a shelving system that is strong, lightweight, and sturdy in appearance. The system is versatile and can be adapted for use in any size closet. Each shelving plank segment is designed to snap on to the horizontal support members in a manner providing positive attachment with no additional hardware required.

SUMMARY OF THE INVENTION

One embodiment of this invention provides a modular shelf assembly for installation into a closet, for example. The assembly comprises a pair of horizontal shelf brackets, each bracket having a plurality of plank securing members along its upper face. A plurality of shelf planks, each shelf plank having a transverse cross section complementary to a plank securing member, elastically engage the shelf brackets.

Supplemental to the above embodiment is at least one vertical support member, a means for attaching one end of the horizontal shelf bracket to the vertical support member and a means for attaching the other end of the horizontal shelf bracket to a wall.

In the assembly of the above exemplary embodiment, a configuration of horizontal shelf brackets, shelf planks, and vertical support members is adapted to fit in a storage space, such as a closet, for example. Each of several horizontal shelf brackets is attached at one end of the bracket to a back wall and at the other end of the bracket to a vertical support member extending upwardly from the floor of the closet.

Each end of a shelf plank is manually snapped onto a plank securing member of the shelf support bracket. The shelf plank elastically engages the plank securing member to form a tight frictional fit requiring no other attachment device or fastener for securing the plank. The number of shelf planks required for the desired shelf depth are similarly attached to the plank securing members, thereby enabling quick and easy assembly of the shelf. The shelf planks are made to nest easily for packaging.

BRIEF DESCRIPTION OF THE DRAWINGS

These and other aspects of the invention will be more fully understood by referring to the following detailed description and the accompanying drawings wherein.

DETAILED DESCRIPTION

Figure 1:
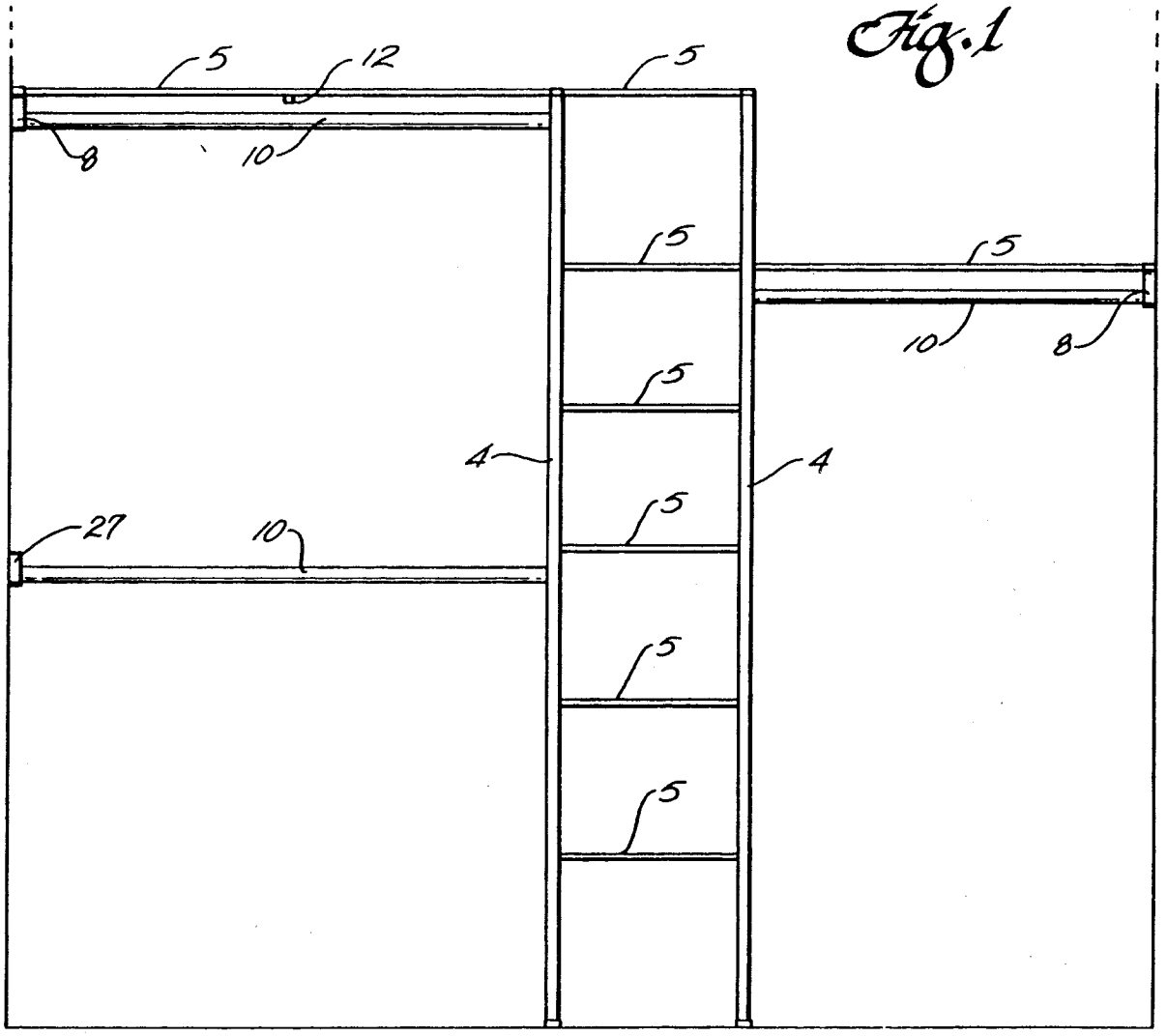
FIG. 1 is a front view of an exemplary configuration of a modular shelving and hanger bar system.

FIG. 1 is a front view of one exemplary configuration of a modular shelving and hanger bar system for installation in a clothes closet, for example. The system can be installed in spaces of varying width and height and many shelf configurations are possible. In this example a pair of vertical support members 4 support a plurality of horizontal support members (not visible in FIG. 1) extending from the each vertical support member to the back wall of a typical closet. The various components of the system are individually described hereinafter.

A plurality of shelf planks 5 extend between corresponding horizontal support members to create a center stack of shelves. Somewhat longer shelf planks extend from each side of the center stack to the respective side walls of a typical closet. A stiffening bridge 12 enhances the sturdiness of the longer shelf members. Support of the longer shelf planks at the sidewall is provided by a sidewall shelf and hanger bar bracket 8. The sidewall bracket also supports one end of a hanger bar 10 provided below each set of shelves extending to the sidewalls. A sidewall hanger bar bracket 27 provides an alternative sidewall support for a hanger bar. The other end of each hanger bar is supported by a socket integral with the corresponding horizontal support bracket.

Figure 2:
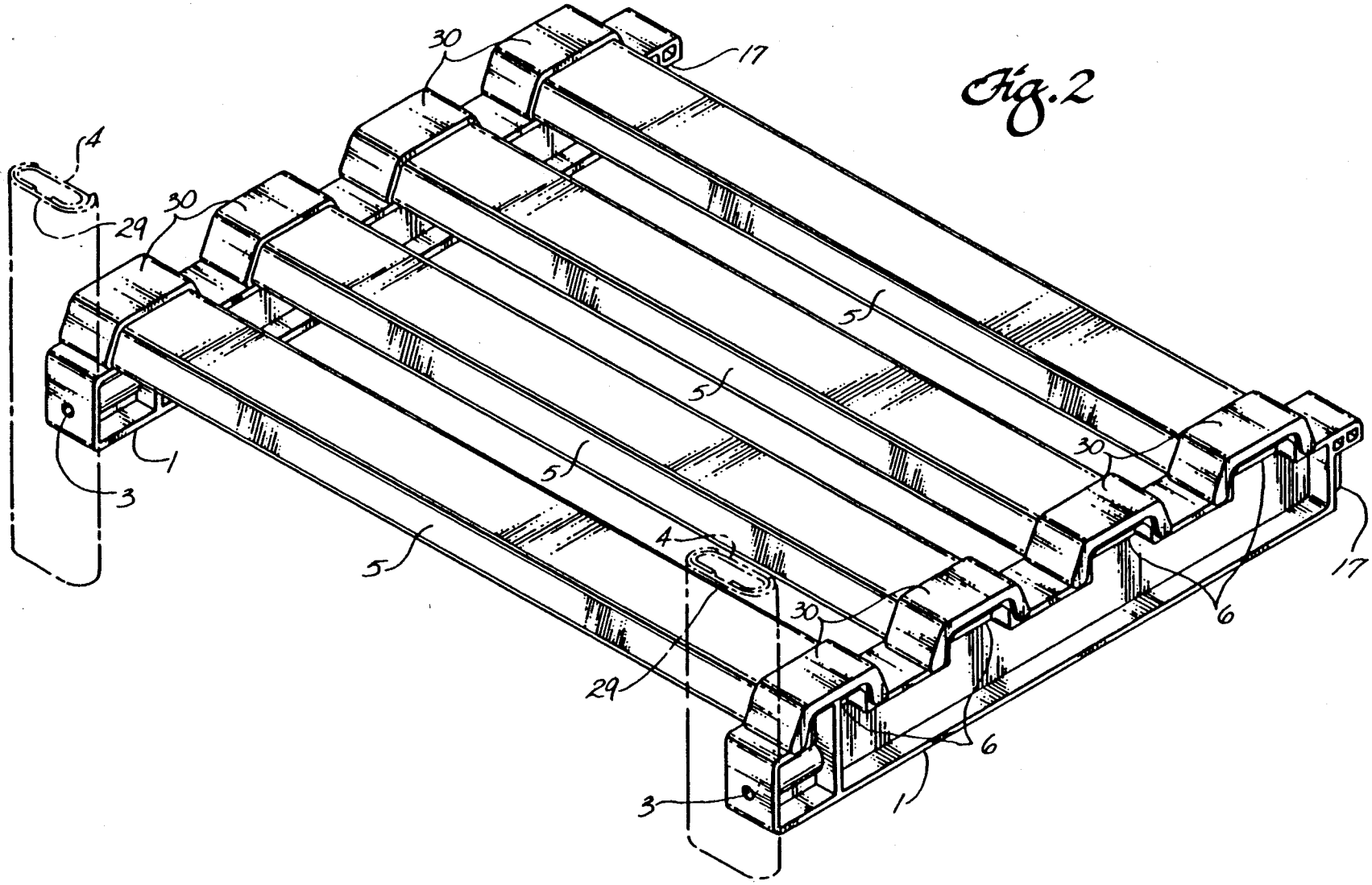
FIG. 2 is an isometric view of one shelf.

FIG. 2 shows the construction of a single shelf from the center stack of the system. In this embodiment, a pair of elongated central shelf brackets 1 are each anchored at the back end to the back wall of the closet by a back wall mounted bracket or stud 15 (FIG. 10) which engages a cleat 17 on the back end of each central bracket. The front end of each central bracket has a screw hole 3 and fastens to a vertical support member 4 which stands on the floor and extends toward the ceiling, but which need not be fastened to the floor or ceiling. The central shelf bracket and vertical support member combination provide the support for a plurality of shelf planks 5 which engage trapezoidal bosses 6 along the top of the central bracket 1. Protective, decorative plank end caps 30 engage and cover the end of each plank.

Figure 3:
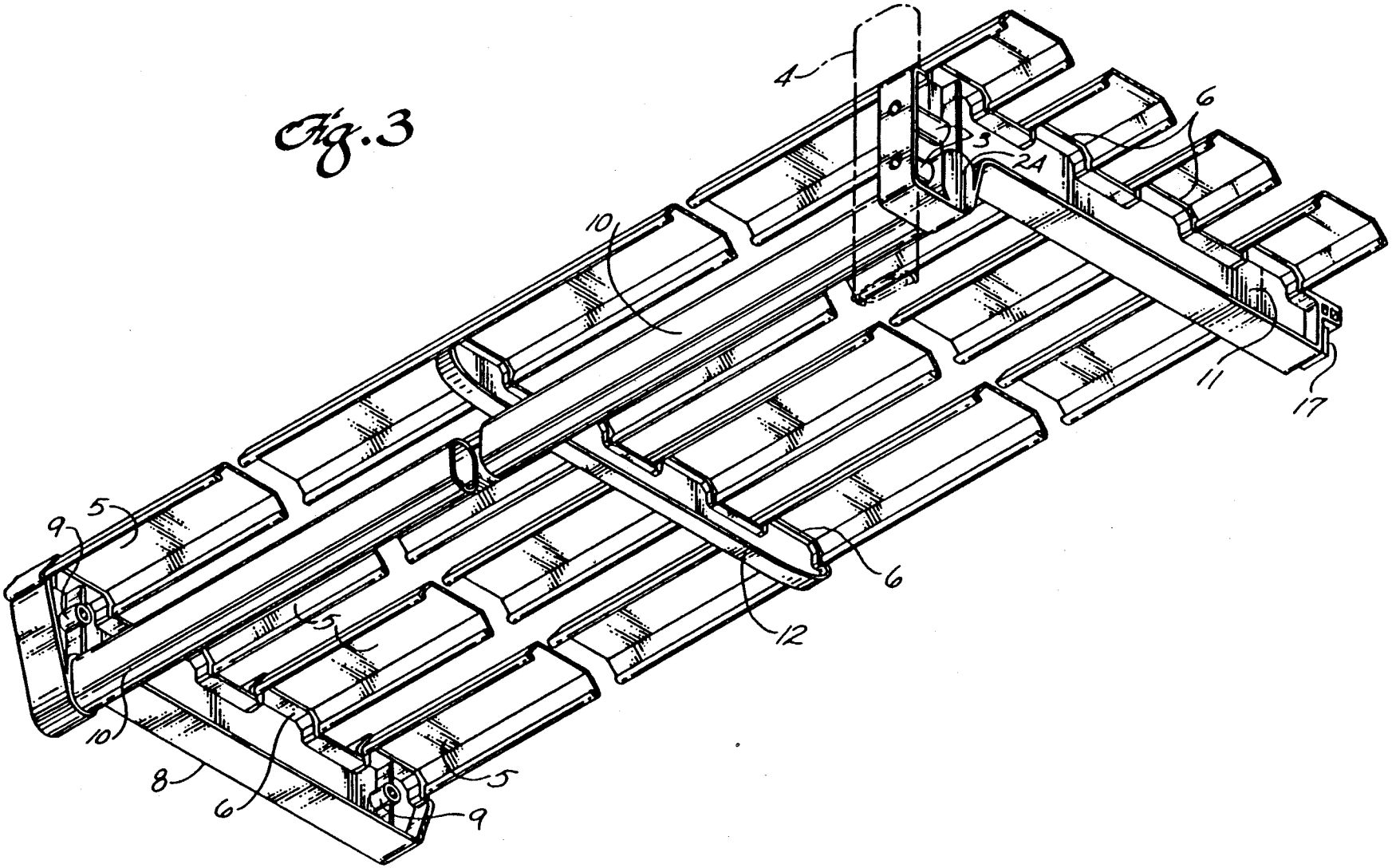
FIG. 3 is an isometric view from below another shelf.

FIG. 3 is an isometric view from below the upper shelf of FIG. 1. A sidewall shelf and hanger bar bracket 8 is mounted to a side wall using mounting screws through mounting holes 9 in the web of the shelf and hanger bar bracket. The sidewall bracket provides support for one end of a plurality of shelf planks 5 and for one end of the hanger bar 10 on which clothes may be hung by hangers, for example.

The back end of a central shelf and hanger bar bracket 11 is anchored to a back wall mounted stud 15 (FIG. 10) by means of a cleat 17 integral with the back edge of the bracket 11, which engages the wall stud. The front end of the bracket contains at least one screw hole 3 by which the bracket is fastened to a vertical support member with at least one screw. The central shelf and hanger bar bracket 11 provides support for the other end of the hanger bar 10 and is a support between the ends of shelf planks 5 which extend to a sidewall (not shown) where the plank ends are supported by a sidewall shelf bracket (hereinafter described). Alternatively, the central shelf and hanger bracket supports one end of a plurality of shelf planks extending to a sidewall shelf bracket.

Figures 4, 5, 6:
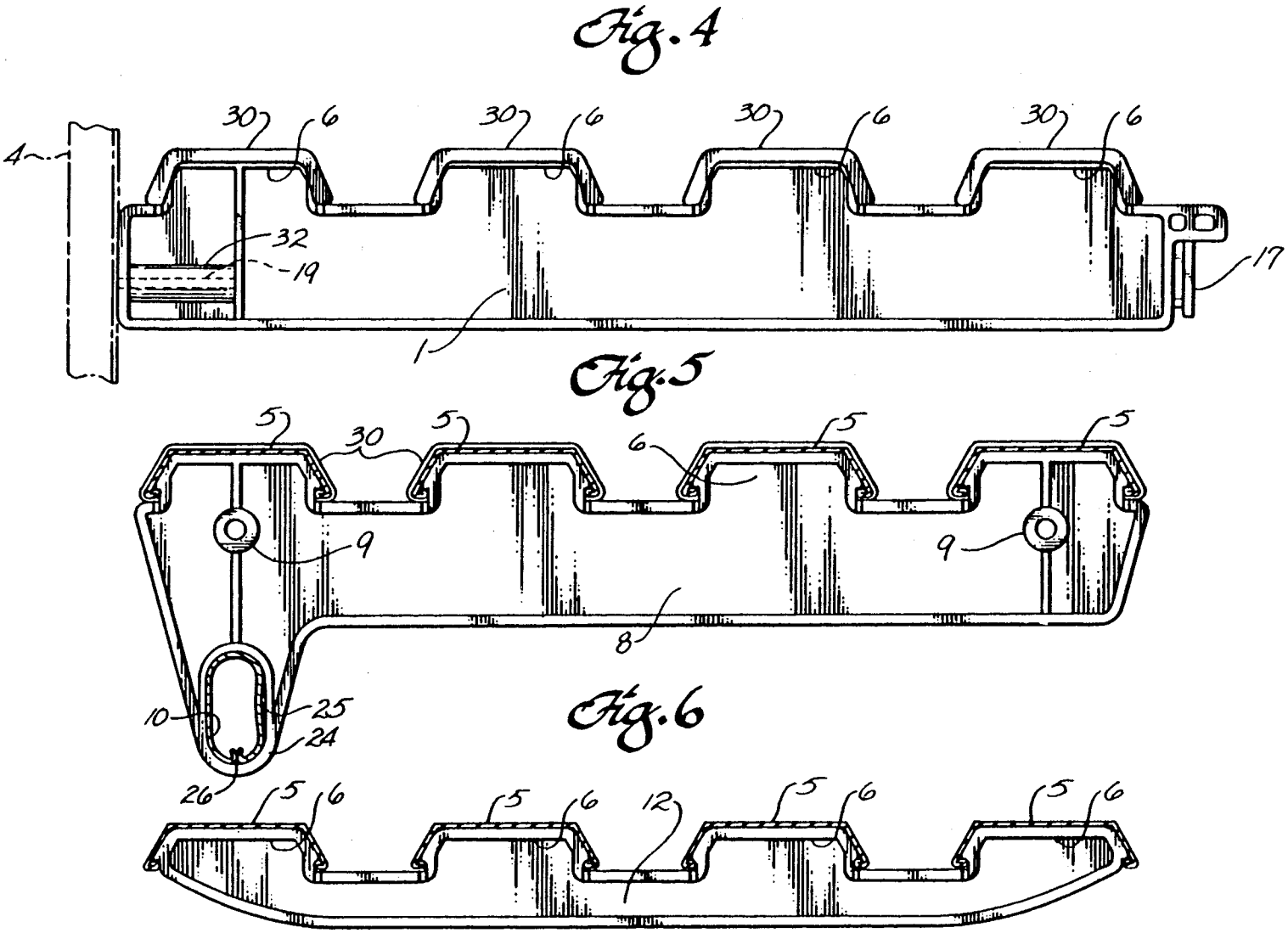
FIG. 4 is a side view of a central shelf bracket with plank end cap.
FIG. 5 is a side view of a sidewall shelf and hanger bar bracket.
FIG. 6 is a side view of a stiffening bridge.

For longer spans of shelf plank, an elongated stiffening bridge 12 may be employed FIG. 6 presents a side view of such a stiffening bridge. The stiffening bridge is of I-beam like cross-section and constructed of plastic such as polypropylene. Trapezoidal bosses 6, each with a shape complementary to a shelf plank, are spaced along the top flange of each bracket at intervals the same as the boss spacing of the central shelf bracket 1 (FIG. 2) and its variations. The stiffening bridge may be inserted into the bottom of a plurality of she-f planks, as shown in FIG. 3 to provide stiffening and stabilization of the shelf planks where there is a relatively long shelf span, about a meter, for example. The bridge distributes the load between the planks, and minimizes deflections of individual planks in the event the load is unevenly distributed.

Figure 8:
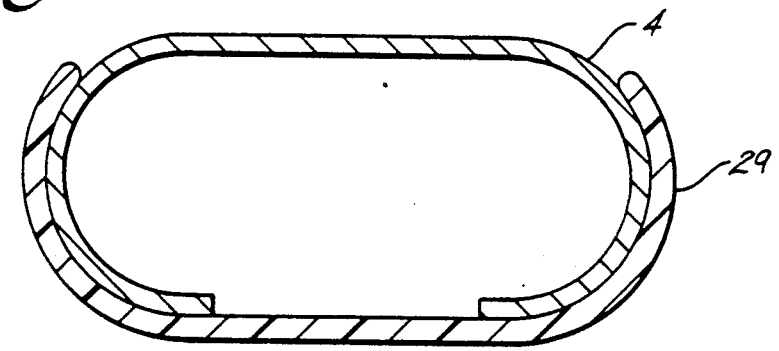
FIG. 8 is a cross-sectional view of a vertical support member and cover strip.

To facilitate packaging of the modular system for retail sales, for example, each vertical support member 4 comprises at least two interconnected shorter members. In one embodiment, each shorter member is formed from metal, preferably lightweight, roll-formed steel and has a length of a little over a meter, for example, with a hollow, somewhat oval, broad base, C-shaped cross-section as shown in FIG. 8. The flat back portion of the support member has labeled screw holes at intervals along the length of the member. The labeled holes are used both as a template for marking the back wall of the closet for hole drilling and as a means for attaching various shelf brackets.

Figure 9:
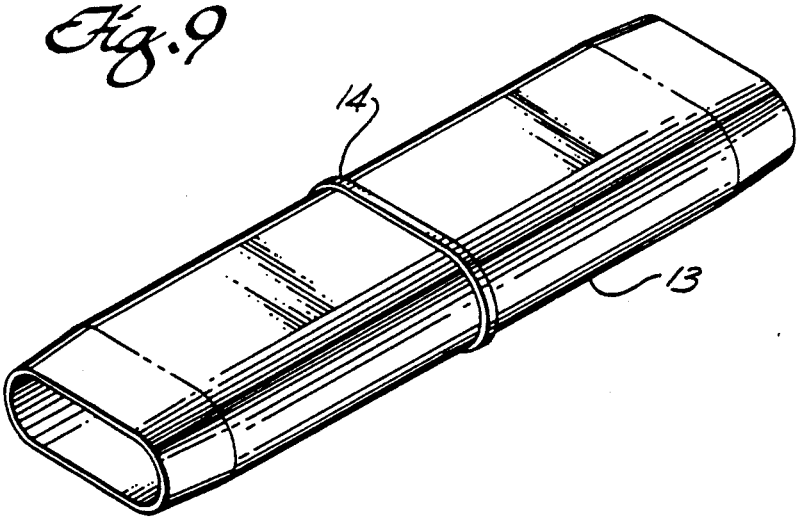
FIG. 9 is an isometric view of a joiner insert for the vertical support members.

The shorter members are interconnected to form the vertical support member by means of a joiner insert 13, one embodiment of which is indicated in FIG. 9. The insert can be formed from hard plastic, preferably glass reinforced polypropylene. In this embodiment, the insert is approximately ten centimeters in length and has a generally oval, broad base cross-section, conforming to the interior cross-section of the vertical support member. A narrow raised rib 14 extends around the circumference of the insert at a point midway between the ends of the insert. Both ends of the insert are hollow and are tapered to facilitate introduction of the insert into an end of the shorter members. The insert is introduced into one end of the shorter member such that the raised rib 14 abuts against the end of the shorter member and acts as a stop. The remaining exposed end of the insert is inserted into the end of a second shorter member, thereby forming the vertical support member 4. Shorter members of any length may be used and any number of them may be connected to comprise the vertical support member.

As mentioned, the holes in the vertical support member serve as a template for marking the back wall of a closet for hole drilling. The wall holes are required to mount the wall studs 15 shown in FIG. 10, which provide support for the back end of the central shelf brackets 1 and the central shelf and hanger bar brackets 11 (FIG. 3). In a preferred embodiment the back wall bracket or stud is a generally rectangular solid having a broadened T-shaped pocket 16 extending down from the top of the stud. The front face of the pocket (the leg of the T) is open from the top. The pocket receives a broadened T-shaped cleat 17 at the back end of a shelf support bracket. The stud has a hole through the back of the T-shaped pocket (hidden in FIG. 10) for receiving a mounting screw. The stud is attached to the wall using any standard screw and wall anchor arrangement.

The T-shaped cleat 17 is integral with one end of the central shelf bracket. The cleat transverse cross-section corresponds to the cross-section of the T-shaped pocket of the wall stud. The top of the cleat is terminated by an extension 18 of the bracket, the extension protruding beyond the edge of the bracket a distance approximately equal to the cross-sectional dimension of the wall stud. Thus, to mount the central shelf bracket, the exposed end of the cleat is inserted into the pocket of the wall stud and slidably engages the stud. The cleat is inserted to the point where the lower face of the solid extension 18 abuts the upper face of the wall stud, the extension thereby acting as a stop. The rear face of the bracket abuts the opposing wall stud face.

As can be seen in FIG. 4, integral with the central shelf bracket, at the end opposite from the rear cleat 17, is a screw boss 32 having a bore 19 with a longitudinal axis parallel to the longitudinal axis of the bracket, for receiving a mounting screw. The front end of the bracket is attached to the vertical support member by a screw through a hole in the flat portion of the vertical support member into a bore 19 in the front end of the bracket. Thus, each central shelf bracket is supported at the front end by the vertical support member and at the rear end by the wall stud 15.

In the preferred embodiment the central shelf bracket also has a symmetrical I-beam type cross-section (viewed in side view in FIG. 4 and in perspective in FIG. 10) and is constructed of plastic such as polypropylene. The top and bottom flanges of each bracket are two centimeters wide, for example, and the overall height is about five centimeters. For a typical closet, the length of a bracket is about 32 centimeters.

Figure 11:
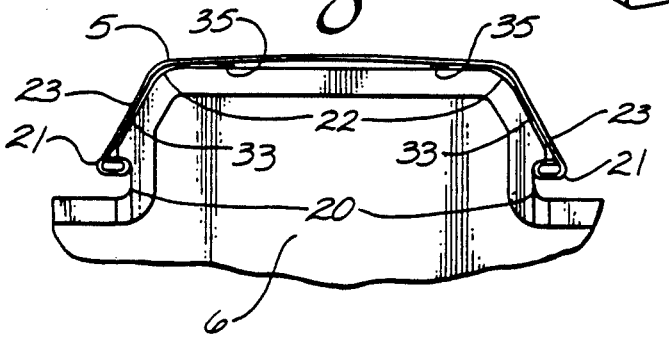
FIG. 11 is a fragmentary side view of a sidewall shelf and hanger bar bracket boss and end of a shelf plank.

Integral with the bracket along the top edge is a plurality of evenly spaced bosses 6. FIG. 11 presents an enlarged side view of such a boss. It is preferable that each boss be so shaped as to allow for an outwardly opposed camming motion of the shelf plank legs, as will be later described. Each boss has a flattened, trapezoidal shape with rounded upper corners 22 and a channel 20 at each side of its base for receiving inwardly directed lips 21 of a shelf plank 5. In other words, the bosses protrude into the notches between bosses a small amount above each channel to provide a place for elastically connecting the planks onto the brackets. A pair of slightly raised ribs 35 extend across the top of the boss transverse to the length of the bracket (illustrated only in FIG. 11).

Each shelf plank has a flattened trapezoidal U-shaped cross-section with an inwardly directed lip 21 at the end of each leg 23 of the U. The descending and diverging legs form the front and rear faces of the plank. Each lip has a double thickness with a lower inwardly directed portion and an upper outwardly directed portion above it. This provides a smooth folded edge along the inward edge of the lip. The rough or sharp cut edge of the steel strip that forms the shelf plank is safely folded inside The distance between the edges of the lips along each edge of the plank is more than the width of the top face of the plank so that a plurality of planks can be nested for packaging and shipment.

The shelf plank may be constructed of any metal, preferably lightweight, roll formed, prepainted steel, which has resilient properties allowing for transverse elastic deformation. The shelf planks may be of differing lengths as desired for making a particular assembly of shelves to fit a closet.

Each shelf plank is attached to a boss by placing the plank in a straddling position over the boss, with one plank leg 23 over each side of the boss, and applying a steady downward pressure. Initially, each inwardly directed lip 21 of the shelf plank abuts a diagonally canted face 33 of the trapezoidal boss. As pressure is applied to the top of the shelf plank, the plank legs are cammed outwardly by the interaction between the shelf plank lips and the diagonal faces of the boss. When each lip travels past the lower edge of the boss, the elasticity of the plank leg causes the lip to be snapped into the boss channel 20, thereby removably locking the shelf plank to the boss.

The raised ribs on top of the boss slightly bend the top face of the plank (shown exaggerated in FIG. 11), further drawing the legs of the U-shaped plank into the channels. The ridges assure tight engagement rigidifying the shelving system. The planks remain elastically bent a small amount when engaged with the bosses to fit tightly. Alternatively, the top of the boss could be slightly rounded or have a raised central area, or the planks could have a slight reverse curvature on their top faces to provide such elastic tightening.

A variety of shelf bracket design configurations are possible, depending on the function the bracket is to serve. For example, in FIG. 3, a central shelf and hanger bar bracket 11 is shown. The bracket, similar in basic shape and properties to the central shelf bracket 1, incorporates a socket 24 for receiving one end of the hanger bar. In this embodiment the socket is positioned below one end of the bracket, but the socket may be positioned at any point along the horizontal length of the bracket if, for example, a wider shelf were desired.

An end view of such a socket into which a hanger bar 10 has been inserted is seen in FIG. 5. The socket has a cross-section to accept one end of a hanger bar and is here shown as oval. Integral with one flat surface of the socket interior is a slight protrusion 25 which engages one of the flat sides of the oval hanger bar, transversely compressing the hanger bar and providing a tight frictional engagement between the socket and the hanger bar end.

The hanger bar may be constructed of metal, preferably resilient roll formed pre-painted steel, and as embodied here has a hollow oval cross-section with a discontinuity 26 in one rounded end. The opposing edges which are adjacent to each other at the discontinuity are safely rolled inward. When the hanger bar end is inserted into the hanger bar socket, the opposing edges are forced toward one another by the compression of the hanger bar caused by the contact of the socket protrusion with the flat side of the hanger bar.

The hanger bar socket shown in FIG. 5 is integral with the illustrated sidewall shelf and hanger bar bracket 8. The sidewall bracket is of similar construction to the central bracket but is supported by a sidewall of a closet, and thus, screw holes 9 pass through the web of the sidewall bracket 8 to allow attachment to a wall.

Figure 7:
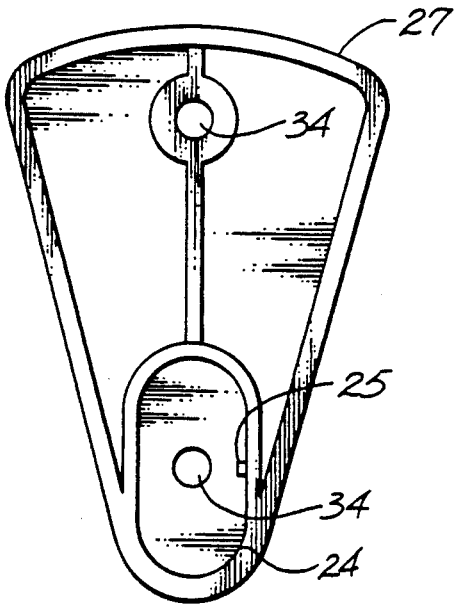
FIG. 7 is a front view of a sidewall hanger bar bracket.

FIG. 7 presents an elevation view of a sidewall hanger bar bracket 27 having two screw holes 34, and a socket, similar to that described in the preceding text, for receiving an end of a hanger bar. One screw hole passes through the rear face of the socket. The sidewall hanger bar bracket is used to support one end of a hanger bar, the other end of which may be supported at the central stack of shelves or the opposite wall.

Cover strips 29 of a cross-section as shown in FIG. 8 may be attached to the vertical support members for cosmetic purposes. Each cover strip is preferably formed from resiliently deformable plastic and is of a hollow oval C-shaped cross-section complementary in interior dimension to the cross-section of the vertical support member and of a length equal to that of a shorter support member. Each cover strip is attached to the front face of a support member by pressing the legs of the strip against the opposing curved ends of the support member. The legs cam opposingly outward and then spring inward as they pass the widest transverse dimension of the support member. The resiliency of the cover strip allows a tight frictional engagement between the cover strip and the vertical support member. The cover strip thus hides the open front of the vertical support member and the screw heads which are inside the vertical support member.

Figure 12:
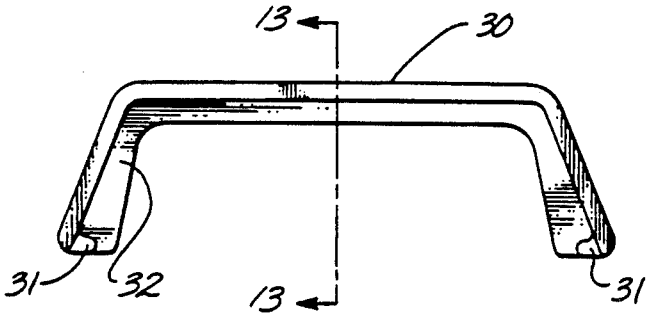
FIG. 12 is a side view of a plank end cap.
Figure 13:
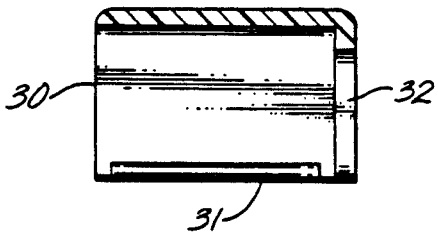
FIG. 13 is a side view taken on line 13—13 of FIG. 12.

Referring to FIGS. 12 and 13, a plastic plank end cap 30 may be employed to cover the sheared end of a shelf plank. The plank end cap is of generally flattened, trapezoidal U-shaped cross-section, complementary to the cross-section of the shelf plank, and has an inwardly directed lip 31 at the end of each leg of the U. A molded rim 32 is integral with one cross-sectional edge and covers and abuts the edge of the junction between the plank end and the shelf bracket boss.

In using the modular shelving and hanger bar system, the user initially decides on an overall shelf and/or hanger bar configuration. Many configurations are possible and can vary in complexity and size from a simple shelf, comprising shelf planks and sidewall shelf brackets and requiring no vertical support member, to a more elaborate combination of brackets, shelf planks and vertical supports such as shown in FIG. 1. Examples of such systems would include: a tower shelf arrangement using at least two vertical support members and at least two central shelf brackets extending from a back wall to the vertical support members and supporting a plurality of shelf planks; a sidewall shelf arrangement having shelf planks supported at one end by a sidewall shelf bracket and at the other end by a central shelf bracket extended between a back wall and a vertical support member; and, at least one hanger bar supported at each end by a sidewall hanger bar bracket mounted between a vertical support member and a rear wall or supported at one end by a side wall hanger bar bracket. These assemblies are merely illustrative of some of the basic configurations possible and are not meant as a comprehensive listing.

Once an overall configuration is chosen, if the configuration is to include vertical support members, these members are assembled to the desired height using the required number of shorter support members in conjunction with joiner inserts. The holes in the assembled vertical support member serve to locate the mounting positions for any required wall studs. The vertical support member is placed in an upright position against the wall and marks are applied to the wall through the screw holes at those heights where wall studs and shelf brackets are to be located. Holes are then drilled into the wall at the marked locations, and screw inserts introduced into the holes. A wall stud is then attached to the wall insert with a screw. The wall stud is oriented such that the T-shape pocket opens in an upward direction.

Figure 10:
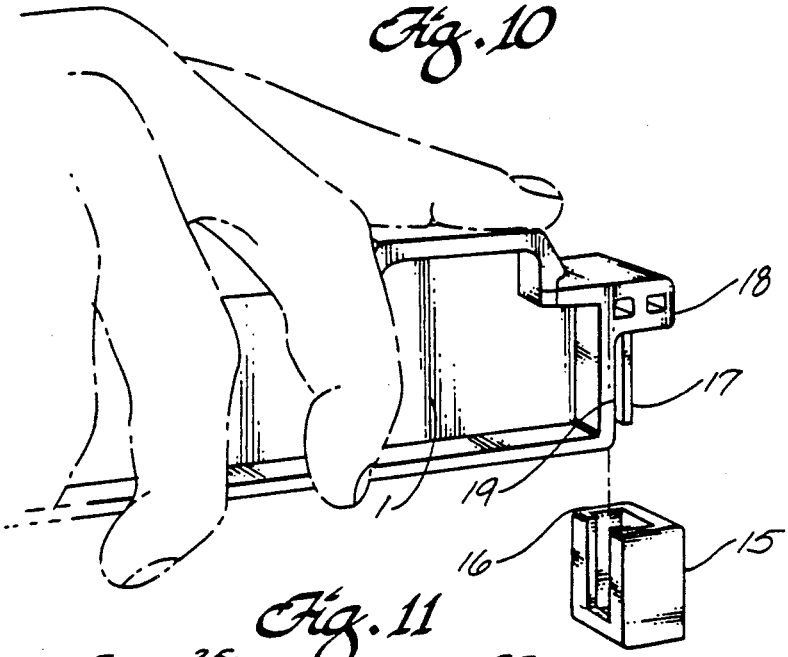
FIG. 10 illustrates the coupling of a central shelf bracket and a back wall bracket or stud.

As shown in FIG. 10, the T-shaped cleat at one end of the shelf bracket is inserted into the opening of the wall stud pocket and depressed to the point that the bottom of the shelf bracket extension abuts the top face of the wall stud. The desired number of shelf brackets are so installed. The front end of each mounted shelf bracket is then attached to the vertical support member using mounting screws. This arrangement of shelf brackets mounted to a wall in vertical alignment, and further supported by a vertical support member, serves as the basic structure from which the illustrated shelving system evolves. This arrangement, combined with a similar arrangement erected at a given lateral distance away provides the framework for a tower shelf configuration as shown in the middle region of FIG. 1.

Shelf planks are precut to a length equal to the distance between the outer edge of a shelf bracket of one vertical arrangement and the outer edge of the corresponding shelf bracket in the second vertical arrangement. Each end of each central tower shelf plank is then snapped into place on a boss of a shelf bracket. Plank end caps may then be snapped on to each exposed junction between plank end and shelf bracket boss for aesthetic and protective purposes. Similarly, cover strips may be applied over the forward facing openings of the vertical support members and caps applied to the tops. Custom-sized shelf planks may be similarly erected between a side wall shelf bracket and one or both of the central shelf brackets. A central shelf and hanger bar bracket may be used in place of a central shelf bracket at selected locations to enable installation of a hanger bar. Again, many configurations are possible.

Thus, the invention provides a modular shelving system that can be easily assembled and installed in closets of any width. The snap-on shelf planks allow ease of construction, a variety of configurations, and a lightweight, strong, and stable structure. There is ample width in the shelf brackets and tolerance in the fits that out of plumb and out of square walls in a closet can be accommodated and still provide a stout and attractive modular shelving system. The only tools needed to install the shelving system are a tape measure, pencil, drill (for the screw receiving plugs in the wall), and a screw driver.

Many modifications and variations of the planks, brackets, etc. are feasible within the scope of this invention. For example, instead of being completely flat on their top faces, the planks may have longitudinal corrugations which are largely a matter of changing the appearance, although some stiffening may also result.

A variety of other patterns of alternating notches and bosses may be provided along the tops of the brackets for elastically engaging shelf planks. For example, planks might be provided with an inverted trapezoidal cross section to fit into notches between bosses. These could be used in lieu of the planks hereinabove described and illustrated, or could, with only minor modifications, be interspersed between the illustrated planks to make a shelf that is essentially continuous instead of being formed of spaced apart planks. If desired, the illustrated planks may be placed closer together to make a stiffer, more nearly continuous upper surface on the shelf. Other shapes of generally U-shaped planks may also be suitable.

For added transverse stability of the center shelf assembly a vertical support member end cap, having a screw hole for attachment to a floor or ceiling, may be used. Such an end cap would receive and anchor an end of the support member, prohibiting lateral motion.

Many similar changes will be apparent and it is therefore to be understood that this invention may be practiced otherwise than as specifically described.

What is claimed is:

1. A self system comprising:

a pair of horizontal shelf brackets, each bracket comprising a plurality of raised plank securing members spaced apart along its upper face for engaging a plurality of shelf planks and retaining each plank at a selected location spaced apart along the length of the shelf bracket; and a plurality of elongated shelf planks on top of the shelf brackets, each plank having a cross section transverse to its length complementary to a raised plank securing member on the shelf brackets for elastically engaging the plank securing member and retaining it on the brackets without additional fasteners.

2. A shelf system according to claim 1 wherein each plank has a generally trapezoidal, U-shaped transverse cross section with a narrower top face and a wider bottom edge with inwardly directed lips for engaging the shelf bracket and inhibiting removal of the plank from the bracket.

3. A shelf system according to claim 1 wherein the top face of each plank is narrower than the space between the inwardly directed lips so that a plurality of planks can be nested.

4. A shelf system comprising:

a pair of horizontal shelf brackets, each bracket comprising a plurality of plank securing members along its upper face, each plank securing member comprising a raised boss of generally U-shape and a recessed channel along opposing sides of the base of the boss; and a plurality of shelf planks on the shelf brackets, each shelf plank being made of an elastically deformable material of generally U-shaped cross-section, and having a transverse cross section complementary to a plank securing member and including an inwardly directed lip along each lengthwise edge for removably engaging the recessed channel of the raised boss for elastically engaging the shelf brackets without additional fasteners.

5. A shelf system according to claim 4 further comprising means on the boss for tightening the plank on the boss.

6. A shelf system according to claim 5 wherein the means for tightening comprises a raised area on the top of the boss for bending the top of the plank.

7. A shelf system comprising:

a pair of horizontal shelf brackets, each bracket having an I-beam like cross section with upper and lower horizontal flanges and an interconnecting web, the upper flange zigzagging up and down to form a plurality of vertically extending plank securing members along the length of the upper flange; and a plurality of shelf planks, each plank having a cross section transverse to its length complementary to a plank securing member for elastically engaging the plank securing member without additional fasteners.

8. A shelf system according to claim 1, including at least one vertical support member engaging and supporting one end of at least one horizontal shelf bracket, and means for supporting the other end of the bracket on an adjoining wall.

9. A modular shelving system comprising:

at least one vertical support means;

a first horizontal support bracket which engages, and is supported by, the vertical support means;

a second horizontal support bracket parallel to the first support bracket, each bracket having a plurality of raised shelf support bosses along the length of the top edge of the bracket for receiving a like plurality of shelf planks; and a plurality of shelf planks extending between an engaging the first and second support brackets, each shelf plank having a generally U-shaped cross-section that is elastically deformable for attachably engaging such a shelf support boss.

10. A shelving system according to claim 9, in which each shelf plank transverse cross-section is complementary in shape to a raised boss for engaging the boss.

11. A shelving system according to claim 10 wherein the boss and plank are sufficiently different that the plank is elastically deformed to grip the boss when installed thereon.

12. A shelving system according to claim 11 wherein each plank is approximately flat on its top face and each boss has a raised area on its top face for elastically deforming the plank.

13. A shelving system according to claim 10, in which:

the raised boss has a generally U-shape and has a recessed channel along opposing sides of its base; and each shelf plank is of an elastically deformable material of generally U-shaped cross-section, and has an inwardly directed lip along each lengthwise edge for removably engaging the recessed channel of the raised boss.

14. A shelving system according to claim 13 wherein each plank is approximately flat on its top face and each boss has a raised area on its top face for elastically deforming the plank.

15. A modular shelving system comprising:

at least one vertical support means;

a first horizontal support bracket which engages, and is supported by, the vertical support means;

a second horizontal support bracket parallel to the first support bracket, each bracket being an elongated member having a plurality of notches along the length of the member for receiving a like plurality of shelf planks and a plurality of shelf planks extending between and engaging the first and second support brackets, each shelf plank having a generally U-shaped transverse cross-section that is elastically deformable for attachably securing the plank in such a notch.

16. A shelving system according to claim 15, in which:

the notch is of generally U-shape and has protrusion on each opposing wall of the notch extending toward the opposite wall for receiving a portion of an elastically deformable shelf plank.

17. A shelf system according to claim 9 wherein each bracket has a I-beam like cross section with upper and lower flanges and an interconnecting web.

18. A kit for assembling a modular shelving system comprising:

a plurality of shelf planks, each plank having a generally U-shaped cross-section;

a plurality of vertical support members; and a plurality of elongated shelf support brackets, each bracket having at one end a means for attachment to one of the vertical support members, at the one end a means for attachment to a wall, and a plurality of bosses along a top edge of the bracket, each boss having a shape complementary to such a shelf plank, for receiving such a plank and securing the plank to the bracket.

19. A kit for assembling a shelving system according to claim 18 in which each shelf plank has a flattened, trapezoidal, U-shaped cross-section with an inwardly directed lip at the end of each leg of the U.

20. A kit for assembling a shelving system according to claim 19 including a plurality of plank end caps for covering the end of each plank at the point where the shelf plank engages the shelf support bracket boss, each end cap having a generally flattened trapezoidal U-shaped cross-section complementary to the cross-section of the shelf plank, an inwardly directed lip at the end of each leg of the U, and a rim along one transverse edge which covers and abuts the junction between the boss junction and the plank end.

21. A kit for assembling a shelving system according to claim 19 wherein each boss includes an undercut channel along each edge for receiving the lips and securing the plank to the boss.

22. A kit for assembling a shelving system according to claim 19 wherein each plank is approximately flat on its top face and each boss has a raised area on its top face for elastically deforming the plank.

23. A kit for assembling a shelving system according to claim 18 in which each vertical support member is comprised of a plurality of interconnected shorter support members of generally C-shaped cross-section having a plurality of holes along the length of each member through the base of the C-shape for receiving a plurality of attachment screws.

24. A kit for assembling a shelving system according to claim 18 including at least one elongated hanger bar beneath a shelf.

25. A kit for assembling a shelving system according to claim 24 including a plurality of shelf of hanger bar brackets, each having:

means for attachment to a wall at one end of the bracket;

means for attachment to the vertical support member at the other end of the bracket;

a plurality of bosses along the top of the bracket, each boss having a shape complementary to the shelf plank for receiving such a plank; and at least one hanger bar socket shaped to match the cross-sectional shape of the hanger bar for slidably receiving the hanger bar to support the hanger bar.

26. A kit for assembling a shelving system according to claim 24 including at least one elongated sidewall shelf hanger bar bracket having:

a plurality of holes for receiving a plurality of mounting screws;

a hanger bar socket, shaped to match the cross-sectional shape of the hanger bar for slidably receiving the hanger bar to support the hanger bar; and a plurality of bosses along the top of the sidewall bracket, each boss having a shape complementary to a shelf plank for receiving such a plank.

27. A kit for assembling a shelving system according to claim 18 including at least a sidewall shelf bracket:

a plurality of holes for receiving a plurality of mounting screws;

a plurality of wall studs having means for fastening to a wall; and a series of bosses along the top of the sidewall shelf bracket, each boss having a shape complementary to a shelf plank for receiving such a plank.

28. A kit for assembling a shelving system according to claim 18 including at least one elongated shelf stiffening bridge having a plurality of bosses along one edge, each boss having a shape complementary to the shelf plank for receiving such a plank.

29. A kit for assembling a shelving system according to claim 18 in which the means for attachment of the shelf support bracket to the wall is a cleat of T-shaped cross-section and each wall stud is a generally rectangular solid, having a hole for receiving a mounting screw and a generally T-shaped pocket which corresponds to the cross-sectional shape of the cleat, for slidably receiving the cleat.

30. A modular shelving and hanger bar system comprising:

a plurality of elongated vertical support members, each support member having a hollow, broadened, C-shape cross-section, and having screw holes through the base of the C-shape at intervals along the length of the member;

a plurality of joiner inserts within an end of each of a pair of adjacent vertical support members for interconnecting the vertical support members; each insert having a solid form with an oval cross-section conforming to the interior of the cross-section of the vertical support members, and having a single, raised, narrow rib extending around the joiner insert in a cross-sectional plane at a point midway between the ends;

a plurality of shelf planks, each plank having a flattened trapezoidal U-shaped cross-section and an inwardly directed lip at the end of each leg of the U;

at least one elongated, hollow, sheet metal hanger bar having a generally oval cross-section with a discontinuity at one rounded end, the edges adjoining each other at the discontinuity each having an inwardly flared portion and the outer surface of each flared portion being in close proximity to the outer surface of the other flared portion;

a plurality of wall studs for supporting a shelf bracket, each wall stud having a squared U-shape cross-section and a lip directed inwardly from the end of each leg of the U, and having a hole through the base of the U for receiving a mounting screw;

a plurality of elongated shelf support brackets supporting a plurality of said shelf planks, each support bracket having:

means at one end for receiving a screw;

at the other end a T-shaped cleat having a cross-section conforming to the interior cross-section of the wall stud;

a plurality of evenly spaced bosses along a top edge, each boss having a flattened, trapezoidal shape with dimensions corresponding to the interior cross-section of the shelf plank for receiving such a plank, the shorter of the parallel edges of each boss being parallel to the top of the support bracket, and the base of each boss having channels along each edge for receiving the inwardly directed lips of the shelf plank; and a socket having an oval cross-section receiving one end of the hanger bar, the socket having along the interior of one flat edge a protrusion which upon insertion of the hanger bar engages the flat side of the hanger bar, thereby compressing the hanger bar;

a plurality of hanger bar wall brackets having:

means for attaching the wall bracket to a wall; and means for receiving one end of a hanger bar;

at least one elongated stiffening bridge beneath a shelf, and having along the top edge a plurality of evenly spaced bosses, each boss having a flattened trapezoidal shape complementary to the interior cross-section of such a shelf plank for receiving such a plank, the shorter of the parallel edges being uppermost from a parallel to the top of the support bracket, and the base of each boss having channels along each edge for receiving the inwardly directed lips of the shelf plank;

a plurality of plank end caps engaging and covering the plank ends, with each end cap of a generally flattened, trapezoidal U-shaped cross-section, an inwardly directed lip at the end of each leg of the U, and a lip at one end of the cap for covering and abutting of the end cap end of the plank;

a plurality of elongated side wall brackets supporting a plurality of said shelf planks, each sidewall bracket having:

means for attachment to a wall; and a plurality of evenly spaced bosses along the top edge, each boss having a flattened, trapezoidal shape complementary to the interior cross-section of a shelf plank for receiving such a plank, the shorter of the parallel edges of each boss uppermost from and parallel to the top of the support bracket, and the base of each boss having channels along each edge for receiving the inwardly directed lips of the shelf plank;

a plurality of cover strips elastically engaging the vertical support members, each cover strip being of a generally C-shaped cross-section complementary to the vertical support member.

* * * * *

UNITED STATES PATENT AND TRADEMARK OFFICE

CERTIFICATE OF CORRECTION

PATENT NO. : 4,995,323

DATED : February 26, 1991

INVENTOR(S) : K.K. Kellems; W.F. Ryczek; D.R. Smith

It is certified that error appears in the above-identified patent and that said Letters Patent is hereby corrected as shown below:

Column 3, line 56, insert a period after "employed".
Column 3, line 64, change "she-f" to -- shelf --.

Column 5, line 41, insert a period after "inside".
Column 5, line 67, after "plank" insert -- toward the sides of the boss and tightening the lips --.
Column 5, line 68, after "engagement" insert -- of the planks with the brackets, stiffening and --.

Column 9, line 61, after "between" change "an" to -- and --.

Column 10, line 53, change "one" to -- other --.(2nd Occur.)

Signed and Sealed this

Tenth Day of November, 1992

*Attest:*

DOUGLAS B. COMER

*Attesting Officer*

*Acting Commissioner of Patents and Trademarks*